US007353880B2

(12) United States Patent
Pietras

(10) Patent No.: US 7,353,880 B2
(45) Date of Patent: Apr. 8, 2008

(54) METHOD AND APPARATUS FOR CONNECTING TUBULARS USING A TOP DRIVE

(75) Inventor: Bernd-Georg Pietras, Wedemark (DE)

(73) Assignee: Weatherford/Lamb, Inc., Houston, TX (US)

( * ) Notice: Subject to any disclaimer, the term of this patent is extended or adjusted under 35 U.S.C. 154(b) by 0 days.

(21) Appl. No.: 11/560,211

(22) Filed: Nov. 15, 2006

(65) Prior Publication Data

US 2007/0084598 A1 Apr. 19, 2007

Related U.S. Application Data

(63) Continuation of application No. 11/288,976, filed on Nov. 29, 2005, which is a continuation of application No. 10/738,950, filed on Dec. 17, 2003, now Pat. No. 7,021,374, which is a continuation of application No. 10/354,226, filed on Jan. 29, 2003, now Pat. No. 6,688,398, which is a continuation of application No. 09/762,698, filed as application No. PCT/GB99/02704 on Aug. 16, 1999, now Pat. No. 6,527,047.

(30) Foreign Application Priority Data

Aug. 24, 1998 (GB) ..... 9818366.8

(51) Int. Cl.
*E21B 19/06* (2006.01)

(52) U.S. Cl. ..... 166/379; 166/77.51

(58) Field of Classification Search ..... None
See application file for complete search history.

(56) References Cited

U.S. PATENT DOCUMENTS 179,973 A 7/1876 Thornton
1,418,766 A 6/1922 Wilson
1,585,069 A 5/1926 Youle
1,728,136 A 9/1929 Power
1,777,592 A 10/1930 Thomas
1,805,007 A 5/1931 Pedley
1,825,026 A 9/1931 Thomas
1,842,638 A 1/1932 Wigle
1,917,135 A 7/1933 Littell
2,105,885 A 1/1938 Hinderliter
2,128,430 A 8/1938 Pryor
2,167,338 A 7/1939 Murcell (Continued)

FOREIGN PATENT DOCUMENTS

CA 2 307 386 11/2000

(Continued)

OTHER PUBLICATIONS

"First Success with Casing-Drilling" Word Oil, Feb. (1999), pp. 25.

(Continued)

*Primary Examiner*—Frank Tsay
(74) *Attorney, Agent, or Firm*—Patterson & Sheridan, LLP

(57) ABSTRACT

An apparatus for facilitating the connection of tubulars, said apparatus comprising a winch, at least one wire line, and a device for gripping the tubular, the arrangement being such that, in use, the winch can be used to winch said at least one wire and said device to position a tubular below said top drive.

24 Claims, 9 Drawing Sheets

U.S. PATENT DOCUMENTS

| | | | | |
|---|---|---|---|---|
| 2,184,681 | A | | 12/1939 | Osmun et al. |
| 2,214,429 | A | | 9/1940 | Miller |
| 2,414,719 | A | | 1/1947 | Cloud |
| 2,522,444 | A | | 9/1950 | Grable |
| 2,538,458 | A | | 1/1951 | Munsinger |
| 2,570,080 | A | | 10/1951 | Stone |
| 2,610,690 | A | | 9/1952 | Beatty |
| 2,641,444 | A | | 6/1953 | Moon |
| 2,668,689 | A | | 2/1954 | Cormany |
| 2,692,059 | A | | 10/1954 | Boiling, Jr. |
| 2,953,406 | A | | 9/1960 | Young |
| 2,965,177 | A | | 12/1960 | Bus, Sr. et al. |
| 3,041,901 | A | | 7/1962 | Knights |
| 3,087,546 | A | | 4/1963 | Wooley |
| 3,122,811 | A | | 3/1964 | Gilreath |
| 3,193,116 | A | | 7/1965 | Kenneday et al. |
| 3,266,582 | A | | 8/1966 | Homanick |
| 3,380,528 | A | | 4/1968 | Timmons |
| 3,392,609 | A | | 7/1968 | Bartos |
| 3,477,527 | A | | 11/1969 | Koot |
| 3,489,220 | A | | 1/1970 | Kinley |
| 3,518,903 | A | | 7/1970 | Ham et al. |
| 3,548,936 | A | | 12/1970 | Kilgore et al. |
| 3,552,507 | A | | 1/1971 | Brown |
| 3,552,508 | A | | 1/1971 | Brown |
| 3,552,509 | A | | 1/1971 | Brown |
| 3,552,510 | A | | 1/1971 | Brown |
| 3,566,505 | A | | 3/1971 | Martin |
| 3,570,598 | A | | 3/1971 | Johnson |
| 3,602,302 | A | | 8/1971 | Kluth |
| 3,606,664 | A | | 9/1971 | Weiner |
| 3,635,105 | A | | 1/1972 | Dickmann et al. |
| 3,638,989 | A | | 2/1972 | Sandquist |
| 3,662,842 | A | | 5/1972 | Bromell |
| 3,680,412 | A | | 8/1972 | Mayer et al. |
| 3,691,825 | A | | 9/1972 | Dyer |
| 3,700,048 | A | | 10/1972 | Desmoulins |
| 3,706,347 | A | | 12/1972 | Brown |
| 3,746,330 | A | | 7/1973 | Taciuk |
| 3,747,875 | A | | 7/1973 | Brown |
| 3,766,991 | A | | 10/1973 | Brown |
| 3,776,320 | A | | 12/1973 | Brown |
| 3,780,883 | A | | 12/1973 | Brown |
| 3,808,916 | A | | 5/1974 | Porter et al. |
| 3,838,613 | A | | 10/1974 | Wilms |
| 3,840,128 | A | | 10/1974 | Swoboda, Jr. et al. |
| 3,848,684 | A | | 11/1974 | West |
| 3,857,450 | A | | 12/1974 | Guier |
| 3,871,618 | A | | 3/1975 | Funk |
| 3,881,375 | A | | 5/1975 | Kelly |
| 3,885,679 | A | | 5/1975 | Swoboda, Jr. et al. |
| 3,901,331 | A | | 8/1975 | Djurovic |
| 3,913,687 | A | | 10/1975 | Gyongyosi et al. |
| 3,915,244 | A | | 10/1975 | Brown |
| 3,964,552 | A | | 6/1976 | Slator |
| 3,980,143 | A | | 9/1976 | Swartz et al. |
| 4,054,332 | A | | 10/1977 | Bryan, Jr. |
| 4,077,525 | A | | 3/1978 | Callegari et al. |
| 4,100,968 | A | | 7/1978 | Delano |
| 4,127,927 | A | | 12/1978 | Hauk et al. |
| 4,142,739 | A | | 3/1979 | Billingsley |
| 4,202,225 | A | | 5/1980 | Sheldon et al. |
| 4,221,269 | A | | 9/1980 | Hudson |
| 4,257,442 | A | | 3/1981 | Claycomb |
| 4,262,693 | A | | 4/1981 | Giebeler |
| 4,274,777 | A | | 6/1981 | Scaggs |
| 4,274,778 | A | | 6/1981 | Putnam et al. |
| 4,280,380 | A | | 7/1981 | Eshghy |
| 4,315,553 | A | | 2/1982 | Stallings |
| 4,320,915 | A | | 3/1982 | Abbott et al. |
| 4,437,363 | A | | 3/1984 | Haynes |
| 4,440,220 | A | | 4/1984 | McArthur |
| 4,446,745 | A | | 5/1984 | Stone et al. |
| 4,449,596 | A | | 5/1984 | Boyadjieff |
| 4,472,002 | A | | 9/1984 | Beney et al. |
| 4,489,794 | A | | 12/1984 | Boyadjieff |
| 4,492,134 | A | | 1/1985 | Reinholdt et al. |
| 4,494,424 | A | | 1/1985 | Bates |
| 4,515,045 | A | | 5/1985 | Gnatchenko et al. |
| 4,529,045 | A | | 7/1985 | Boyadjieff et al. |
| 4,570,706 | A | | 2/1986 | Pugnet |
| 4,592,125 | A | | 6/1986 | Skene |
| 4,593,584 | A | | 6/1986 | Neves |
| 4,593,773 | A | | 6/1986 | Skeie |
| 4,604,724 | A | | 8/1986 | Shaginian et al. |
| 4,604,818 | A | | 8/1986 | Inoue |
| 4,605,077 | A | | 8/1986 | Boyadjieff |
| 4,613,161 | A | | 9/1986 | Brisco |
| 4,625,796 | A | | 12/1986 | Boyadjieff |
| 4,646,827 | A | | 3/1987 | Cobb |
| 4,649,777 | A | | 3/1987 | Buck |
| 4,652,195 | A | | 3/1987 | McArthur |
| 4,667,752 | A | | 5/1987 | Berry et al. |
| 4,676,312 | A | | 6/1987 | Mosing et al. |
| 4,681,158 | A | | 7/1987 | Pennison |
| 4,681,162 | A | | 7/1987 | Boyd |
| 4,683,962 | A | | 8/1987 | True |
| 4,686,873 | A | | 8/1987 | Lang et al. |
| 4,709,599 | A | | 12/1987 | Buck |
| 4,709,766 | A | | 12/1987 | Boyadjieff |
| 4,725,179 | A | | 2/1988 | Woolslayer et al. |
| 4,735,270 | A | | 4/1988 | Fenyvesi |
| 4,738,145 | A | | 4/1988 | Vincent et al. |
| 4,742,876 | A | | 5/1988 | Barthelemy et al. |
| 4,753,300 | A | * | 6/1988 | Shaw et al. ..... 173/164 |
| 4,759,239 | A | | 7/1988 | Hamilton et al. |
| 4,762,187 | A | | 8/1988 | Haney |
| 4,765,401 | A | * | 8/1988 | Boyadjieff ..... 166/77.53 |
| 4,765,416 | A | | 8/1988 | Bjerking et al. |
| 4,773,689 | A | | 9/1988 | Wolters |
| 4,781,359 | A | | 11/1988 | Matus |
| 4,791,997 | A | | 12/1988 | Krasnov |
| 4,793,422 | A | | 12/1988 | Krasnov |
| 4,800,968 | A | | 1/1989 | Shaw et al. |
| 4,813,493 | A | * | 3/1989 | Shaw et al. ..... 173/164 |
| 4,813,495 | A | | 3/1989 | Leach |
| 4,821,814 | A | | 4/1989 | Willis et al. |
| 4,832,552 | A | | 5/1989 | Skelly |
| 4,836,064 | A | | 6/1989 | Slator |
| 4,843,945 | A | | 7/1989 | Dinsdale |
| 4,867,236 | A | | 9/1989 | Haney et al. |
| 4,878,546 | A | | 11/1989 | Shaw et al. |
| 4,899,816 | A | | 2/1990 | Mine |
| 4,909,741 | A | | 3/1990 | Schasteen et al. |
| 4,921,386 | A | | 5/1990 | McArthur |
| 4,936,382 | A | | 6/1990 | Thomas |
| 4,962,579 | A | | 10/1990 | Moyer et al. |
| 4,962,819 | A | | 10/1990 | Bailey et al. |
| 4,971,146 | A | | 11/1990 | Terrell |
| 4,997,042 | A | | 3/1991 | Jordan et al. |
| 5,022,472 | A | | 6/1991 | Bailey et al. |
| 5,036,927 | A | | 8/1991 | Willis |
| 5,049,020 | A | | 9/1991 | McArthur |
| 5,060,542 | A | | 10/1991 | Hauk |
| 5,062,756 | A | | 11/1991 | McArthur et al. |
| 5,107,940 | A | | 4/1992 | Berry |
| 5,111,893 | A | | 5/1992 | Kvello-Aune |
| RE34,063 | E | | 9/1992 | Vincent et al. |
| 5,191,939 | A | | 3/1993 | Stokley |
| 5,233,742 | A | | 8/1993 | Gray et al. |
| 5,245,265 | A | | 9/1993 | Clay |
| 5,251,709 | A | | 10/1993 | Richardson |
| 5,255,751 | A | | 10/1993 | Stogner |
| 5,272,925 | A | | 12/1993 | Henneuse et al. |

| | | | |
|---|---|---|---|
| 5,282,653 | A | 2/1994 | LaFleur et al. |
| 5,284,210 | A | 2/1994 | Helms et al. |
| 5,294,228 | A | 3/1994 | Willis et al. |
| 5,297,833 | A | 3/1994 | Willis et al. |
| 5,305,839 | A | 4/1994 | Kalsi et al. |
| 5,332,043 | A | 7/1994 | Ferguson |
| 5,340,182 | A | 8/1994 | Busink et al. |
| 5,351,767 | A | 10/1994 | Stogner et al. |
| 5,354,150 | A | 10/1994 | Canales |
| 5,368,113 | A | 11/1994 | Schulze-Beckinghausen |
| 5,386,746 | A | 2/1995 | Hauk |
| 5,388,651 | A | 2/1995 | Berry |
| 5,433,279 | A | 7/1995 | Tessari et al. |
| 5,461,905 | A | 10/1995 | Penisson |
| 5,497,840 | A | 3/1996 | Hudson |
| 5,501,280 | A | 3/1996 | Brisco |
| 5,501,286 | A | 3/1996 | Berry |
| 5,503,234 | A | 4/1996 | Clanton |
| 5,535,824 | A | 7/1996 | Hudson |
| 5,575,344 | A | 11/1996 | Wireman |
| 5,577,566 | A | 11/1996 | Albright et al. |
| 5,584,343 | A | 12/1996 | Coone |
| 5,588,916 | A | 12/1996 | Moore |
| 5,645,131 | A | 7/1997 | Trevisani |
| 5,661,888 | A | 9/1997 | Hanslik |
| 5,667,026 | A | 9/1997 | Lorenz et al. |
| 5,706,894 | A | 1/1998 | Hawkins, III |
| 5,711,382 | A | 1/1998 | Hansen et al. |
| 5,735,348 | A | 4/1998 | Hawkins, III |
| 5,735,351 | A | 4/1998 | Helms |
| 5,746,276 | A | 5/1998 | Stuart |
| 5,765,638 | A | 6/1998 | Taylor |
| 5,772,514 | A | 6/1998 | Moore |
| 5,785,132 | A | 7/1998 | Richardson et al. |
| 5,791,410 | A | 8/1998 | Castille et al. |
| 5,803,191 | A | 9/1998 | Mackintosh |
| 5,833,002 | A | 11/1998 | Holcombe |
| 5,836,395 | A | 11/1998 | Budde |
| 5,839,330 | A | 11/1998 | Stokka |
| 5,842,530 | A | 12/1998 | Smith et al. |
| 5,850,877 | A | 12/1998 | Albright et al. |
| 5,890,549 | A | 4/1999 | Sprehe |
| 5,909,768 | A | 6/1999 | Castille et al. |
| 5,931,231 | A | 8/1999 | Mock |
| 5,960,881 | A | 10/1999 | Allamon et al. |
| 5,971,079 | A | 10/1999 | Mullins |
| 5,971,086 | A | 10/1999 | Bee et al. |
| 6,000,472 | A | 12/1999 | Albright et al. |
| 6,012,529 | A | 1/2000 | Mikolajczyk et al. |
| 6,056,060 | A | 5/2000 | Abrahamsen et al. |
| 6,065,550 | A | 5/2000 | Gardes |
| 6,070,500 | A | 6/2000 | Dlask et al. |
| 6,079,509 | A | 6/2000 | Bee et al. |
| 6,119,772 | A | 9/2000 | Pruet |
| 6,142,545 | A | 11/2000 | Penman et al. |
| 6,161,617 | A | 12/2000 | Gjedebo |
| 6,170,573 | B1 | 1/2001 | Brunet et al. |
| 6,173,777 | B1 | 1/2001 | Mullins |
| 6,199,641 | B1 | 3/2001 | Downie et al. |
| 6,202,764 | B1 | 3/2001 | Ables et al. |
| 6,217,258 | B1 | 4/2001 | Yamamoto et al. |
| 6,227,587 | B1 | 5/2001 | Terral |
| 6,237,684 | B1 | 5/2001 | Bouligny, Jr. et al. |
| 6,276,450 | B1 | 8/2001 | Seneviratne |
| 6,279,654 | B1 | 8/2001 | Mosing et al. |
| 6,309,002 | B1 | 10/2001 | Bouligny |
| 6,311,792 | B1 | 11/2001 | Scott et al. |
| 6,315,051 | B1 | 11/2001 | Ayling |
| 6,334,376 | B1 | 1/2002 | Torres |
| 6,349,764 | B1 | 2/2002 | Adams et al. |
| 6,360,633 | B2 | 3/2002 | Pietras |
| 6,378,630 | B1 | 4/2002 | Ritorto et al. |
| 6,390,190 | B2 | 5/2002 | Mullins |
| 6,412,554 | B1 | 7/2002 | Allen et al. |
| 6,431,626 | B1 | 8/2002 | Bouligny |
| 6,443,241 | B1 | 9/2002 | Juhasz et al. |
| 6,527,047 | B1 | 3/2003 | Pietras |
| 6,527,493 | B1 | 3/2003 | Kamphorst et al. |
| 6,536,520 | B1 | 3/2003 | Snider et al. |
| 6,553,825 | B1 | 4/2003 | Boyd |
| 6,591,471 | B1 | 7/2003 | Hollingsworth et al. |
| 6,595,288 | B2 | 7/2003 | Mosing et al. |
| 6,622,796 | B1 | 9/2003 | Pietras |
| 6,637,526 | B2 | 10/2003 | Juhasz et al. |
| 6,651,737 | B2 | 11/2003 | Bouligny |
| 6,668,684 | B2 | 12/2003 | Allen et al. |
| 6,679,333 | B2 | 1/2004 | York et al. |
| 6,688,394 | B1 | 2/2004 | Ayling |
| 6,688,398 | B2 | 2/2004 | Pietras |
| 6,691,801 | B2 | 2/2004 | Juhasz et al. |
| 6,725,938 | B1 | 4/2004 | Pietras |
| 6,732,822 | B2 | 5/2004 | Slack et al. |
| 6,742,584 | B1 | 6/2004 | Appleton |
| 6,742,596 | B2 | 6/2004 | Haugen |
| 6,832,656 | B2 | 12/2004 | Keast |
| 6,832,658 | B2 | 12/2004 | Fournier, Jr. et al. |
| 6,840,322 | B2 | 1/2005 | Haynes |
| 6,892,835 | B2 | 5/2005 | Shahin et al. |
| 6,907,934 | B2 | 6/2005 | Kauffman et al. |
| 7,096,977 | B2 | 8/2006 | Juhasz et al. |
| 7,100,698 | B2 | 9/2006 | Kracik et al. |
| 7,219,744 | B2 | 5/2007 | Pietras |
| 2001/0042625 | A1 | 11/2001 | Appleton |
| 2002/0029878 | A1 | 3/2002 | Victor |
| 2002/0108748 | A1 | 8/2002 | Keyes |
| 2002/0170720 | A1 | 11/2002 | Haugen |
| 2003/0155159 | A1 | 8/2003 | Slack et al. |
| 2003/0164276 | A1 | 9/2003 | Snider et al. |
| 2003/0173073 | A1 | 9/2003 | Snider et al. |
| 2003/0221519 | A1 | 12/2003 | Haugen et al. |
| 2004/0003490 | A1 | 1/2004 | Shahin et al. |
| 2004/0069500 | A1 | 4/2004 | Haugen |
| 2004/0144547 | A1 | 7/2004 | Koithan et al. |
| 2004/0173358 | A1 | 9/2004 | Haugen |
| 2004/0216924 | A1 | 11/2004 | Pietras et al. |
| 2004/0251050 | A1 | 12/2004 | Shahin et al. |
| 2004/0251055 | A1 | 12/2004 | Shahin et al. |
| 2005/0000691 | A1 | 1/2005 | Giroux et al. |
| 2005/0051343 | A1 | 3/2005 | Pietras et al. |
| 2005/0096846 | A1 | 5/2005 | Koithan et al. |
| 2005/0098352 | A1 | 5/2005 | Beierbach et al. |

FOREIGN PATENT DOCUMENTS

| | | |
|---|---|---|
| DE | 3 523 221 | 2/1987 |
| EP | 0 087 373 | 8/1983 |
| EP | 0 162 000 | 11/1985 |
| EP | 0 171 144 | 2/1986 |
| EP | 0 285 386 | 10/1988 |
| EP | 0 474 481 | 3/1992 |
| EP | 0 479 583 | 4/1992 |
| EP | 0 525 247 | 2/1993 |
| EP | 0 589 823 | 3/1994 |
| EP | 1148206 | 10/2001 |
| EP | 1 256 691 | 11/2002 |
| GB | 1 469 661 | 4/1977 |
| GB | 2 053 088 | 2/1981 |
| GB | 2 201 912 | 9/1988 |
| GB | 2 223 253 | 4/1990 |
| GB | 2 224 481 | 9/1990 |
| GB | 2 240 799 | 8/1991 |
| GB | 2 275 486 | 4/1993 |
| GB | 2 345 074 | 6/2000 |
| GB | 2 357 530 | 8/2000 |
| JP | 2001/173349 | 6/2001 |
| WO | WO 90-06418 | 6/1990 |

| | | |
|---|---|---|
| WO | WO 92-18743 | 10/1992 |
| WO | WO 93-07358 | 4/1993 |
| WO | WO 95-10686 | 4/1995 |
| WO | WO 96-18799 | 6/1996 |
| WO | WO 97-08418 | 3/1997 |
| WO | WO 98-11322 | 3/1998 |
| WO | WO 98-32948 | 7/1998 |
| WO | WO 98-05844 | 12/1998 |
| WO | WO 99-11902 | 3/1999 |
| WO | WO-41485 | 8/1999 |
| WO | WO 99-58810 | 11/1999 |
| WO | WO 00-08293 | 2/2000 |
| WO | WO 00-09853 | 2/2000 |
| WO | WO 00-11309 | 3/2000 |
| WO | WO 00-11310 | 3/2000 |
| WO | WO 00-11311 | 3/2000 |
| WO | WO 00-39429 | 7/2000 |
| WO | WO 00-39430 | 7/2000 |
| WO | WO 00-50730 | 8/2000 |
| WO | WO 01-12946 | 2/2001 |
| WO | WO 01-33033 | 5/2001 |
| WO | WO 01-94738 | 12/2001 |
| WO | WO 04-022903 | 3/2004 |

OTHER PUBLICATIONS

Laurent, et al., "A New Generation Drilling Rig: Hydraulically Powered And Computer Controlled," CADE/CAODC Paper 99-120, CADE/CAODC Spring Drilling Conference, Apr. 7 & 8, 1999, 14 pages.

Laurent, et al., "Hydraulic Rig Supports Casing Drilling," World Oil, Sep. 1999, pp. 61-68.

Shepard, et al., "Casing Drilling: An Emerging Technology," IADC/SPE Paper 67731, SPE/IADC Drilling Conference, Feb. 27-Mar. 1, 2001, pp. 1-13.

Warren, et al., "Casing Drilling Technology Moves To More Challenging Application," AADE Paper 01-NC-HO-32, AADE National Drilling Conference, Mar. 27-29, 2001, pp. 1-10.

Fontenot, et al., "New Rig Design Enhances Casing Drilling Operations in Lobo Trend," paper WOCD-0306-04, World Oil Casing Drilling Technical Conference, Mar. 6-7, 2003, pp. 1-13.

Vincent, et al., "Liner And Casing Drilling—Case Histories And Technology," Paper WOCD-0307-02, World Oil Casing Drilling Technical Conference, Mar. 6-7, 2003, pp. 1-20.

Tessari, et al., "Retrievable Tools Provide Flexibility for Casing Drilling," Paper No. WOCD-0306-01, World Oil Casing Drilling Technical Conference, 2003, pp. 1-11.

Tommy Warren, SPE, Bruce Houtchens, SPE, Garret Madell, SPE, Directional Drilling With Casing, SPE/IADC 79914, Tesco Corporation, SPE/IADC Drilling Conference 2003.

LaFleur Petroleum Services, Inc., "Autoseal Circulating Head," Engineering Manufacturing, 1992, 11 Pages.

Canrig Top Drive Drilling Systems, Harts Petroleum Engineer International, Feb. 1997, 2 Pages.

The Original Portable Top Drive Drilling System, TESCO Drilling Technology, 1997.

Mike Killalea, Portable Top Drives: What's Driving The Marked?, IADC, Drilling Contractor, Sep. 1994, 4 Pages.

500 or 650 ECIS Top Drive, Advanced Permanent Magnet Motor Technology, TESCO Drilling Technology, Apr. 1998, 2 Pages.

500 or 650 HCIS Top Drive, Powerful Hydraulic Compact Top Drive Drilling System, TESCO Drilling Technology, Apr. 1998, 2 Pages.

Product Information (Sections 1-10) CANRIG Drilling Technology, Ltd., Sep. 18, 1996.

Coiled Tubing Handbook, World Oil, Gulf Publishing Company, 1993.

Bickford L Dennis and Mark J. Mabile, Casing Drilling Rig Selection For Stratton Field, Texas, World Oil, vol. 226, No. 3, Mar. 2005.

G H. Kamphorst, G. L. Van Wechem, W. Boom, D. Bottger, and K. Koch, Casing Running Tool, SPE/IADC 52770.

* cited by examiner 13
20
19
15
14
12
11
9
6
7
8
10
2
16
21
22
3
18

METHOD AND APPARATUS FOR CONNECTING TUBULARS USING A TOP DRIVE

CROSS-REFERENCE TO RELATED APPLICATIONS

This application is a continuation of co-pending U.S. patent application Ser. No. 11/288,976, filed on Nov. 29, 2005; which is a continuation of U.S. patent application Ser. No. 10/738,950, filed on Dec. 17, 2003, now U.S. Pat. No. 7,021,374; which is a continuation of U.S. patent application Ser. No. 10/354,226, filed on Jan. 29, 2003, now U.S. Pat. No. 6,688,398; which is a continuation of U.S. patent application Ser. No. 09/762,698, filed on May 10, 2001, now issued U.S. Pat. No. 6,527,047, issued Mar. 4, 2003; which claims priority to PCT/GB99/02704, filed on Aug. 16,1999; which claims benefit of GB 9818366.8 filed Aug. 24, 1998, filed in Great Britain. Each of the aforementioned related patent applications is herein incorporated by reference in their entirety.

BACKGROUND OF THE INVENTION

1. Field of the Invention

This invention relates to a method and apparatus for facilitating the connection of tubulars using a top drive and is, more particularly but not exclusively, for facilitating the connection of a section or stand of casing to a string or casing.

2. Description of the Related Art

In the construction of wells such as oil or gas wells, it is usually necessary to line predrilled holes with a string of tubulars known as casing. Because of the size of the casing required, sections or stands of say two sections of casing are connected to each other as they are lowered into the well from a platform. The first section or stand of casing is lowered into the well and is usually restrained from falling into the well by a spider located in the platform's floor. Subsequent sections or stands of casing are moved from a rack to the well centre above the spider. The threaded pin of the section or stand of casing to be connected is located over the threaded box of the casing in the well to form a string of casing. The connection is made-up by rotation therebetween.

It is common practice to use a power tong to torque the connection up to a predetermined torque in order to perfect the connection. The power tong is located on the platform, either on rails, or hung from a derrick on a chain. However, it has recently been proposed to use a top drive for making such connection.

Prior to the present invention, pipe handling devices moved pipes to be connected to a tubular string from a rack to the well centre using articulated arms or, more commonly, a pipe elevator suspended from the drilling tower.

The present invention provides an alternative to these devices.

SUMMARY OF THE INVENTION

Accordingly, a first aspect of the present invention provides an apparatus for facilitating the connection of tubulars, said apparatus comprising a winch, at least one wire line and a device for gripping a tubular the arrangement being such that, in use, the winch can be used to winch said at least one wire and said device to position a tubular below said top drive.

Further features are set out in claims 2 to 6.

According to a second aspect of the present invention there is provided a method of facilitating the connection of tubulars using a top drive and comprising the steps of attaching at least one wire to a tubular, the wire depending from the top drive or from a component attached thereto, and winching the wire and the tubular upwards to a position beneath the top drive.

According to a third aspect of the present invention there is provided an apparatus for facilitating the connection of tubulars using a top drive, said apparatus comprising an elevator and a pair of bails, characterized in that said elevator is, in use, movable in relation to said pair of bails.

According to a fourth aspect of the present invention there is provided: an apparatus for facilitating the connection of tubulars using a top drive, said apparatus comprising an elevator and a pair of bails, characterized in that said elevator is, in use, movable relative to said pair of bails.

BRIEF DESCRIPTION OF THE DRAWINGS

For a better understanding of the present invention and in order to show how the same may be carried into effect reference will now be made, by way of example, to the accompanying drawings in which.

DETAILED DESCRIPTION OF THE PREFERRED EMBODIMENT

Figure 1A:
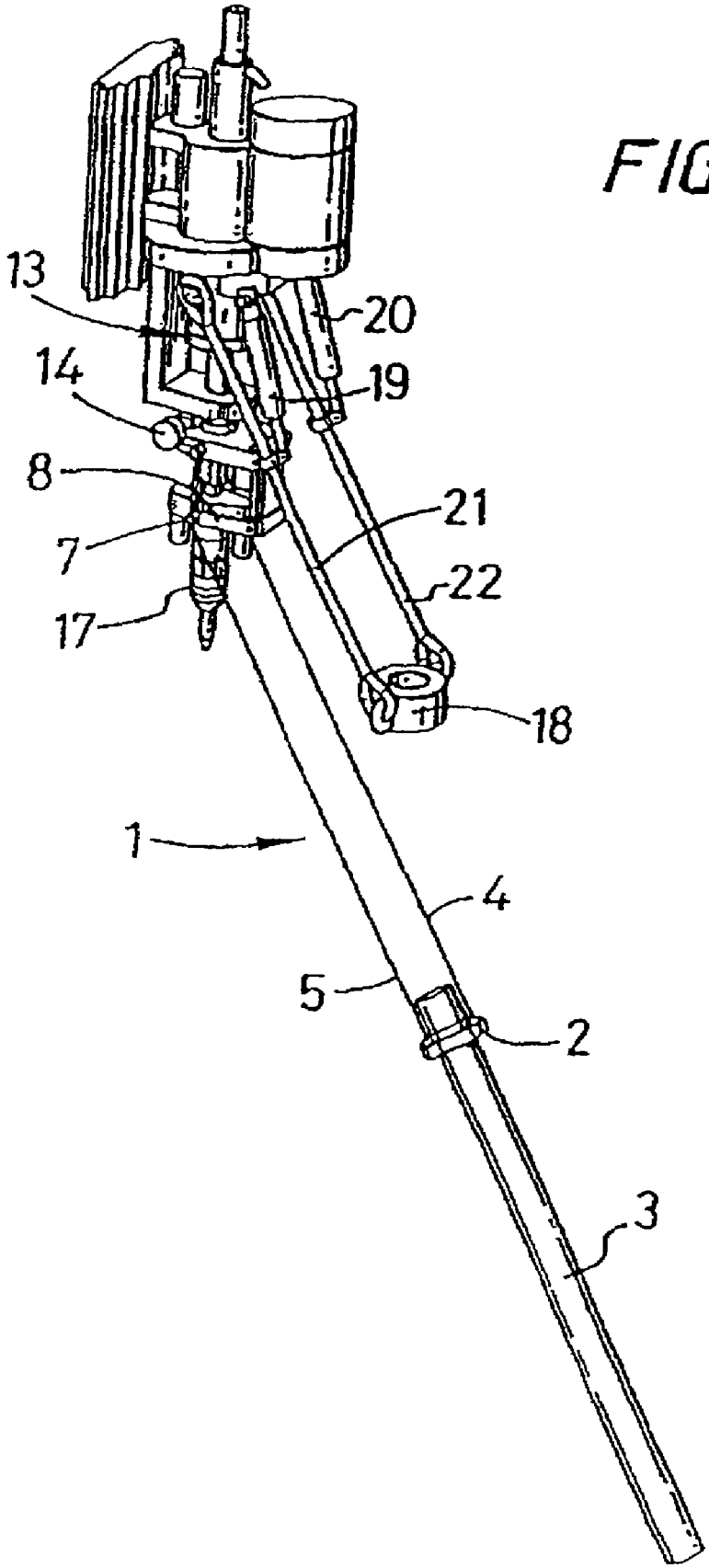
FIGS. 1*a* to 1*e* are perspective views of an apparatus in accordance with a first embodiment of the present invention at various stages of operation.

Referring to FIGS. 1*a* to 1*e* there is shown an apparatus which is generally identified by reference numeral 1.

The apparatus 1 comprises a clamp 2 for retaining a tubular 3. The clamp 2 is suspended on wires 4, 5 which are connected thereto on opposing sides thereof. The wire 5 passes through an eye 6 in lug 7 which is attached to a spherical bearing in arm 8 of a suspension unit 9 at the point at which the arm 8 is connected to a hydraulic motor. The wire is connected to the hydraulic motor 10 in a corresponding manner. The suspension unit 9 is of a type which enables displacement of the tubular 3 when connected to a tool 17 (see below), relative to a top drive 13, along a number of different axes. The wires 4, 5 pass across the suspension unit 9 and over pulley wheels 11 which are rotatably arranged on a plate 12. The plate 12 is fixed in relation to a top drive generally identified by reference numeral 13. The wires 4, 5 then pass over drums 14 to which the wires 4, 5 are also connected. The drums 14 are rotatable via a hydraulic winch motor 15.

Figure 1B:
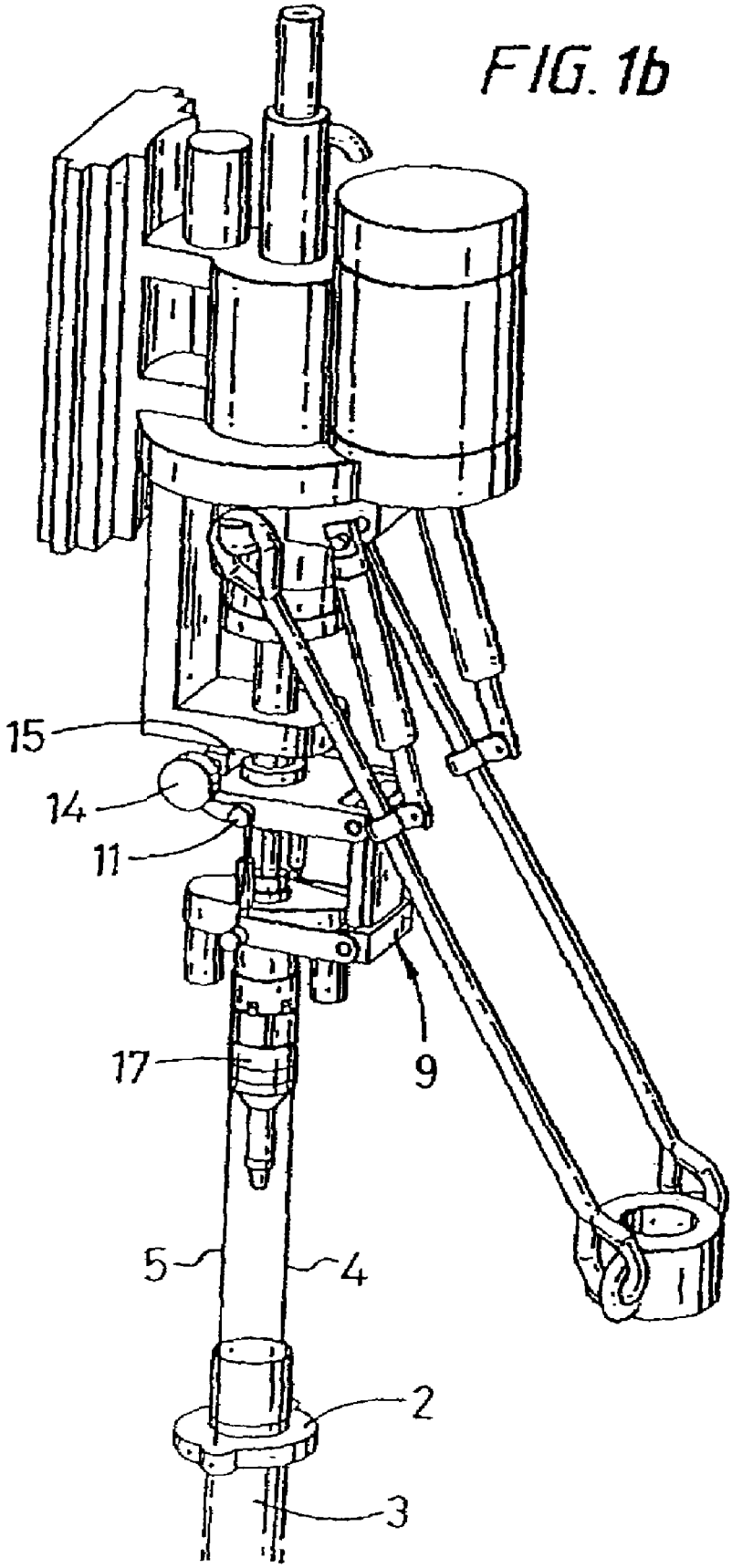
Figure 1C:
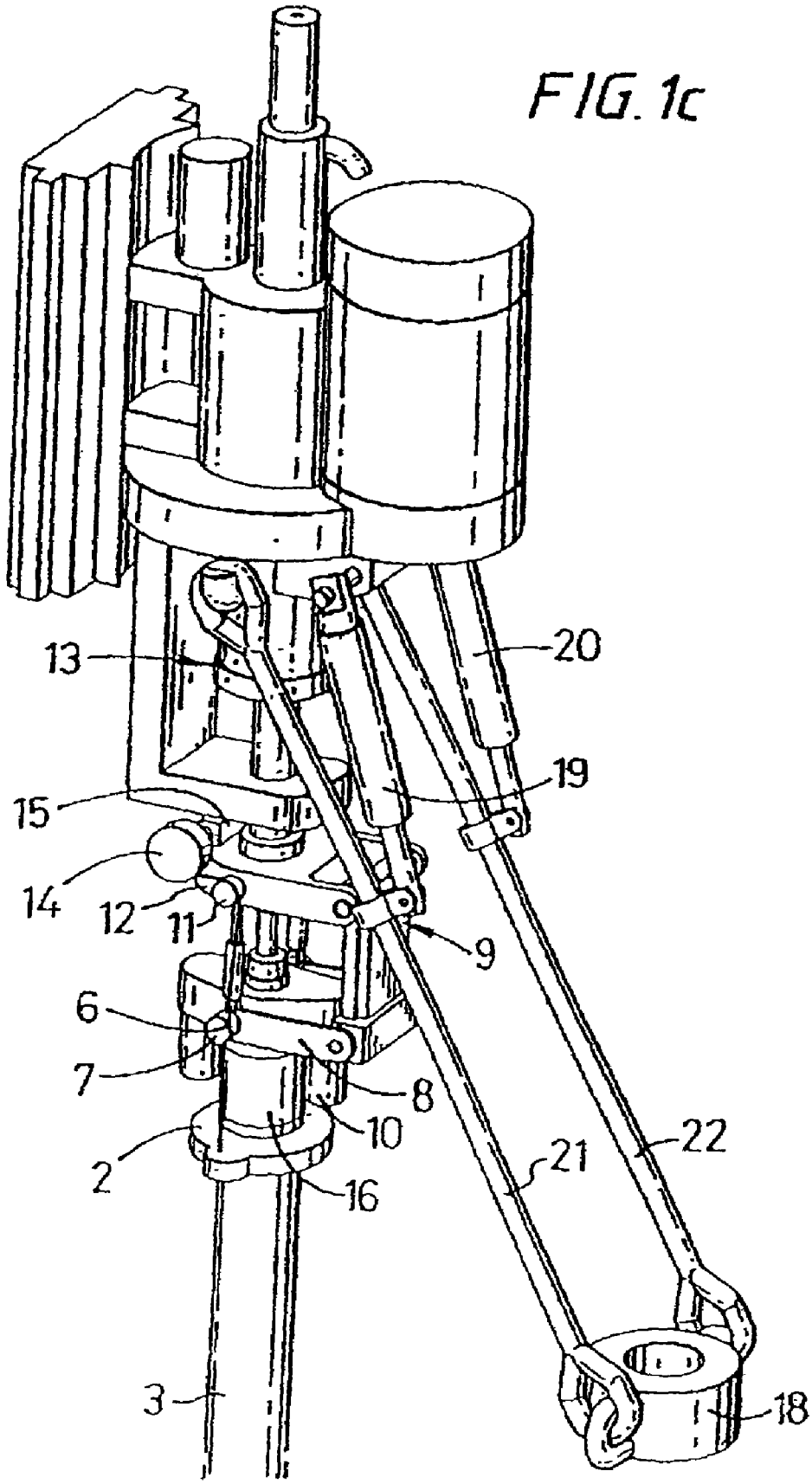

In use, the clamp 2 is placed around a tubular below a box 16 thereof. The hydraulic winch motor 15 is then activated, which lifts the tubular 3 (conveniently from a rack) and towards a tool 17 for gripping the tubular 3 (FIG. 1*b*). The tubular 3 encompasses the tool 17 at which point the hydraulic winch motor 15 is deactivated (FIG. 1*c*). During this operation the elevator 18 is held away from the tool 17 by piston and cylinders 19, 20 acting on bails 21 and 22. The suspension unit 9 allows the hydraulic motor 10 and the arrangement depending therebelow to move in vertical and horizontal planes relative to the top drive 13. The eyes 6 in lugs 7 maintain the wires 4 and 5 in line with the tubular 3 during any such movement. The tool 17 may now be used to connect the tubular to the tubular string. More particularly, the tool may be of a type which is inserted into the upper end of the tubular, with gripping elements of the tool being radially displaceable for engagement with the inner wall of the tubular so as to secure the tubular to the tool. Once the tool is secured to the tubular, the hydraulic motor 10 is activated which rotates the tool 17 and hence the tubular 3 for engagement with a tubular string held in a spider.

Figure 1D:
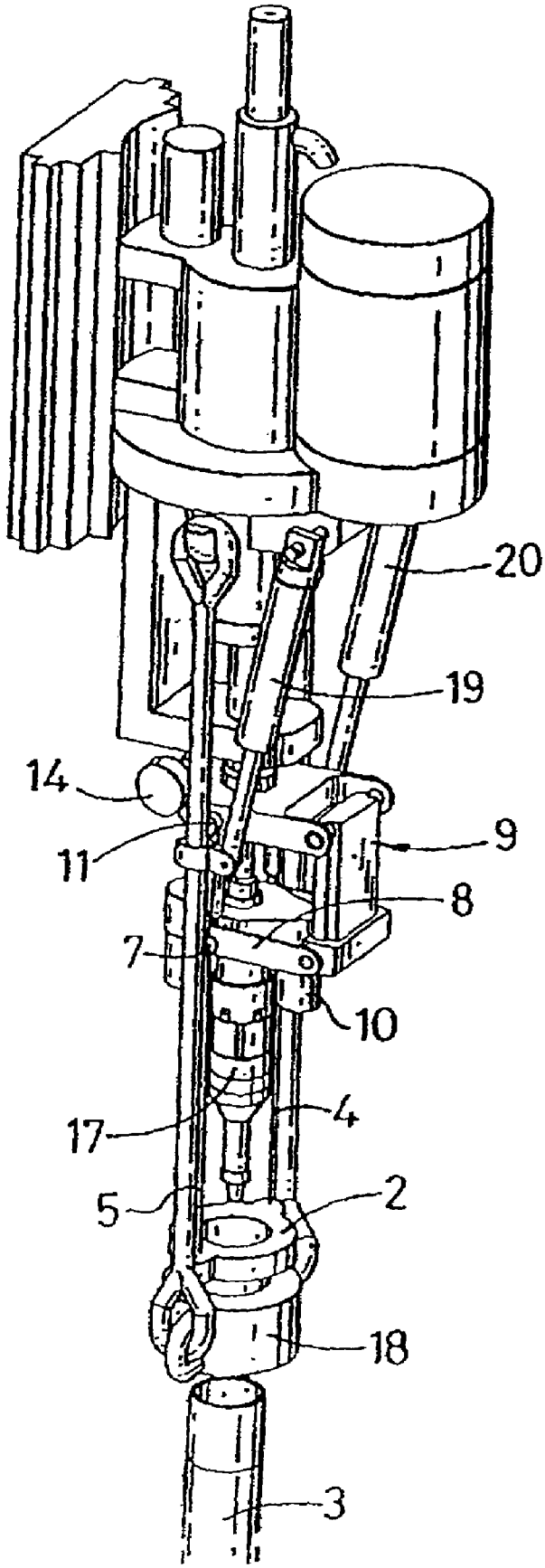
Figure 1E:
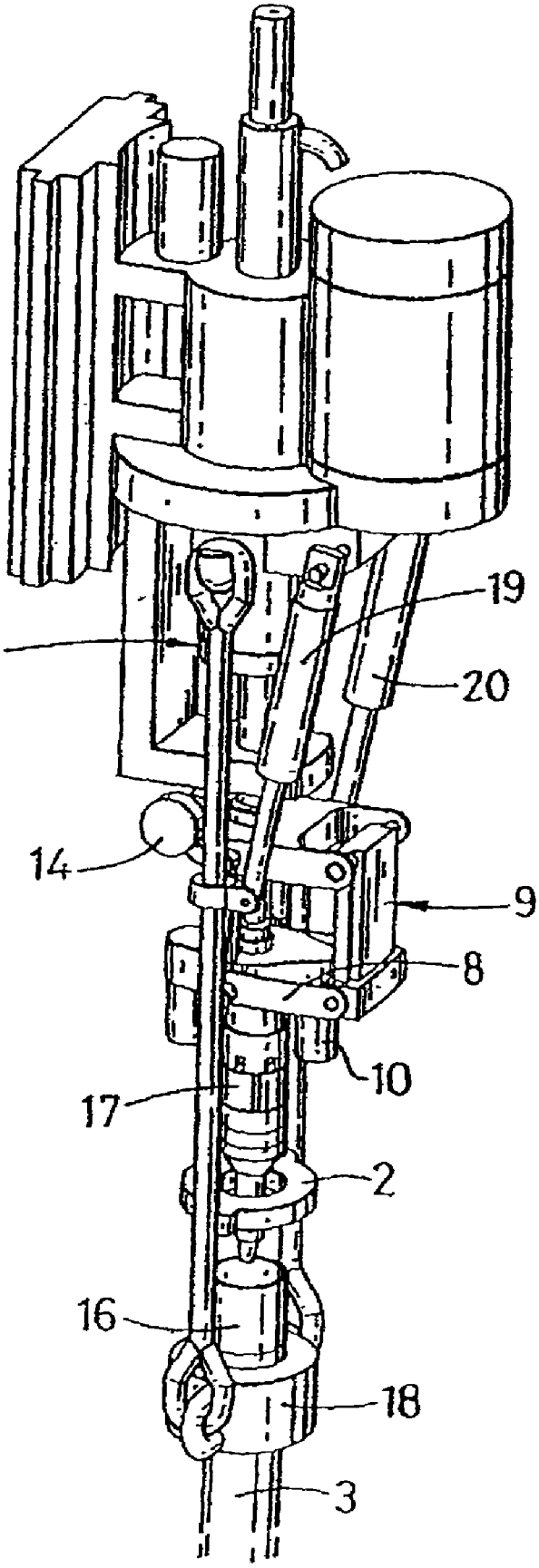

The clamp 2 is now released from the tubular 3, and the top drive 13 and hence apparatus 1 is now lifted clear of the tubular 3. The elevator 18 is now swung in line with the apparatus 1 by actuation of the piston and cylinders 19 and 20 (FIG. 1*d*).

The top drive 13 is then lowered, lowering the elevator 18 over the box 16 of the tubular 3. The slips in the elevator 18 are then set to take the weight of the entire tubular string. The top drive is then raised slightly to enable the slips in the spider to be released and the top drive is then lowered to introduce the tubular string into the borehole.

Referring to FIGS. 2*a* to 2*d* there is shown an apparatus which is generally identified by reference numeral 101.

The apparatus 101 comprises an elevator 102 arranged at one end of bails 103, 104. The bails 103, 104 are movably attached to a top drive 105 via axles 106 which are located in eyes 107 in the other end of the bails 103, 104. Piston and cylinders 108, 109 are arranged between the top drive 105 and the bails. One end of the piston and cylinders 108, 109 are movably arranged on axles 110 on the top drive. The other end of the piston and cylinders 108, 109 are movably arranged on axles 111, 112 which are located in lugs 113, 114 located approximately one-third along the length of the bails 103, 109.

The elevator 102 is provided with pins 115 on either side thereof and projecting therefrom. The pins 115 are located in slots 116 and 116*g*. A piston 117, 118 and cylinder 119, 120 are arranged in each of the bails 103, 104. The cylinders are arranged in slot 121, 122. The piston 117, 118 are connected at their ends to the pins 115. The cylinders 119, 120 are prevented from moving along the bails 103, 104 by cross members 123 and 124. A hole is provided in each of the cross members to allow the pistons to move therethrough.

Figure 2A:
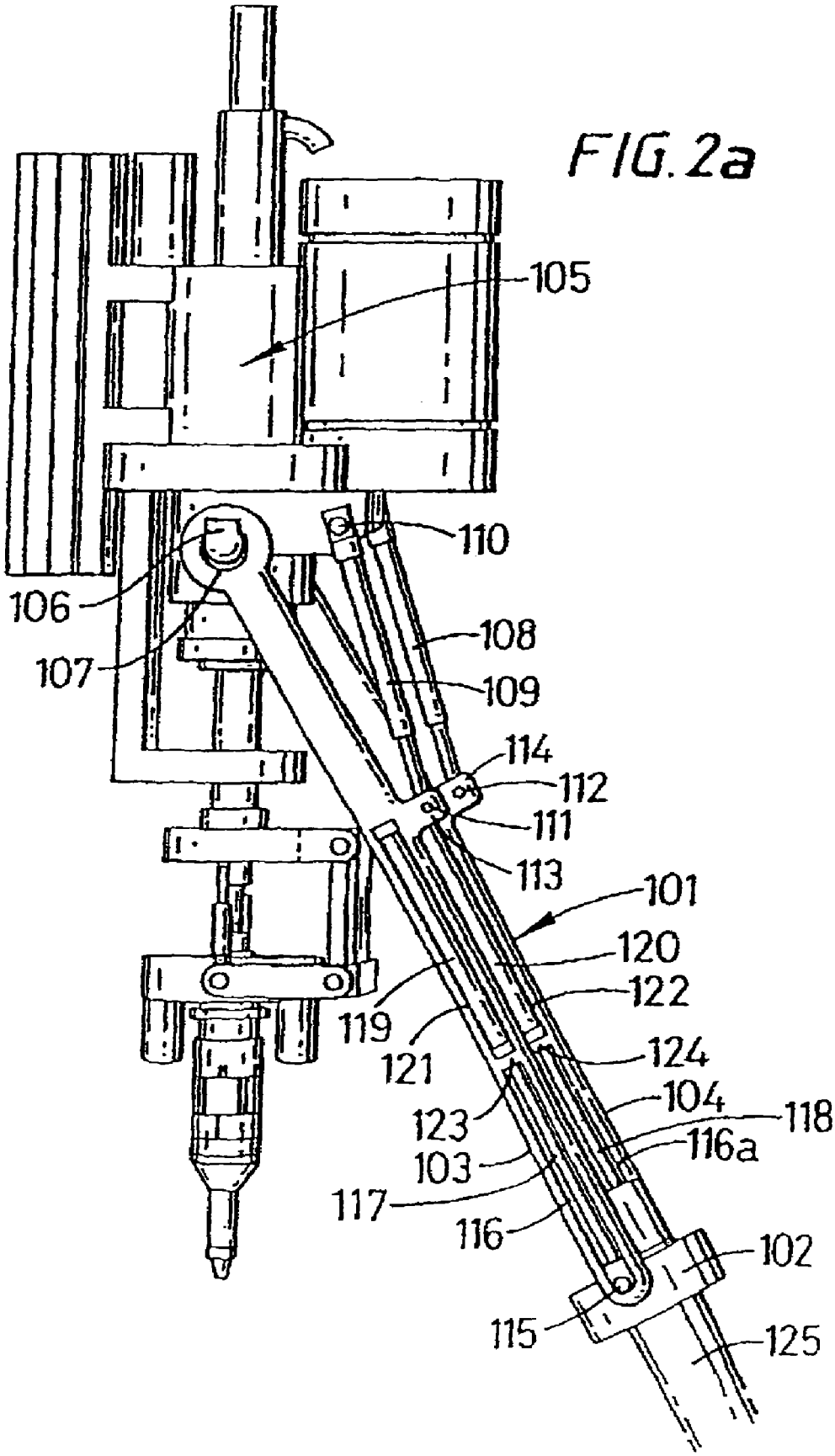
FIGS. 2*a* to 2*d* are perspective views of an apparatus in accordance with a second embodiment of the invention at various stages of operation.
Figure 2B:
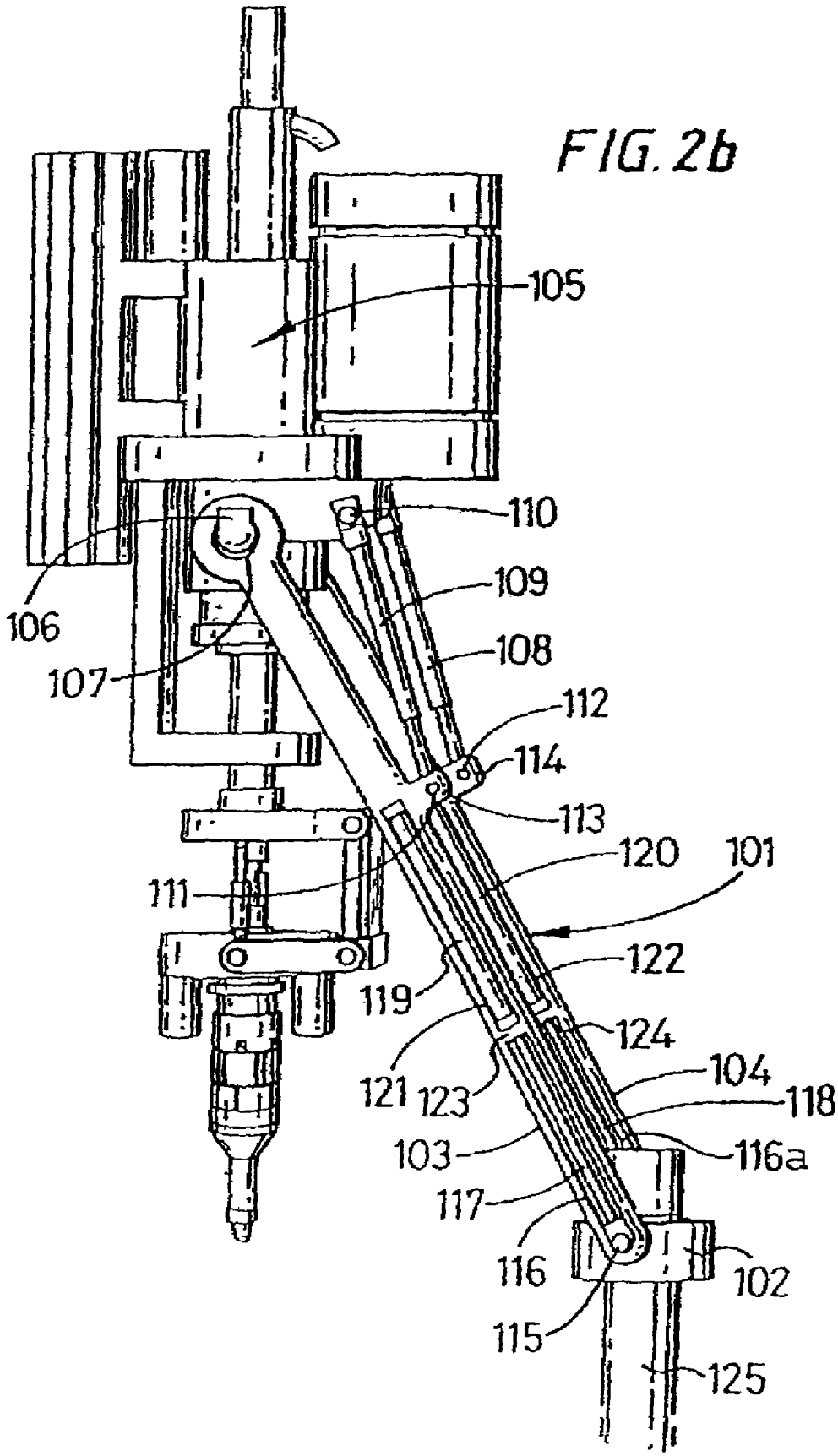
Figure 2C:
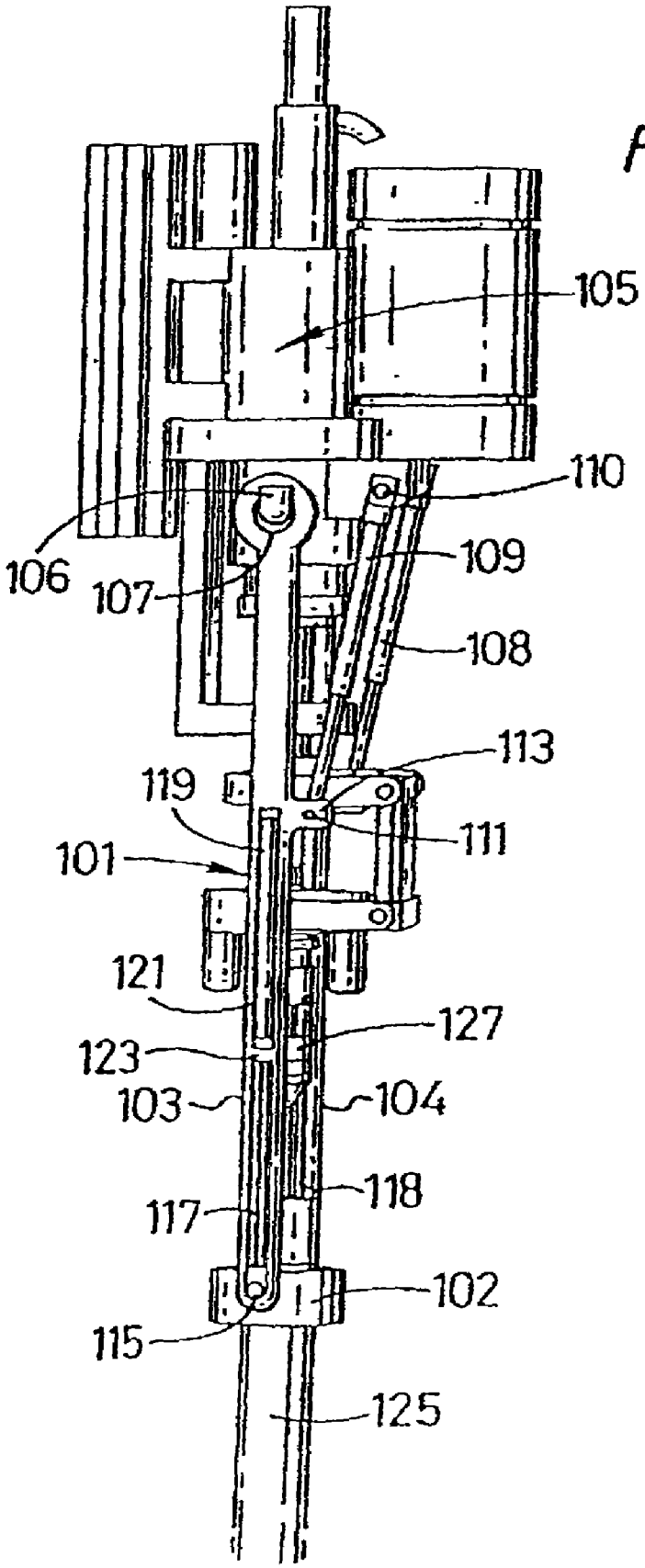
Figure 2D:
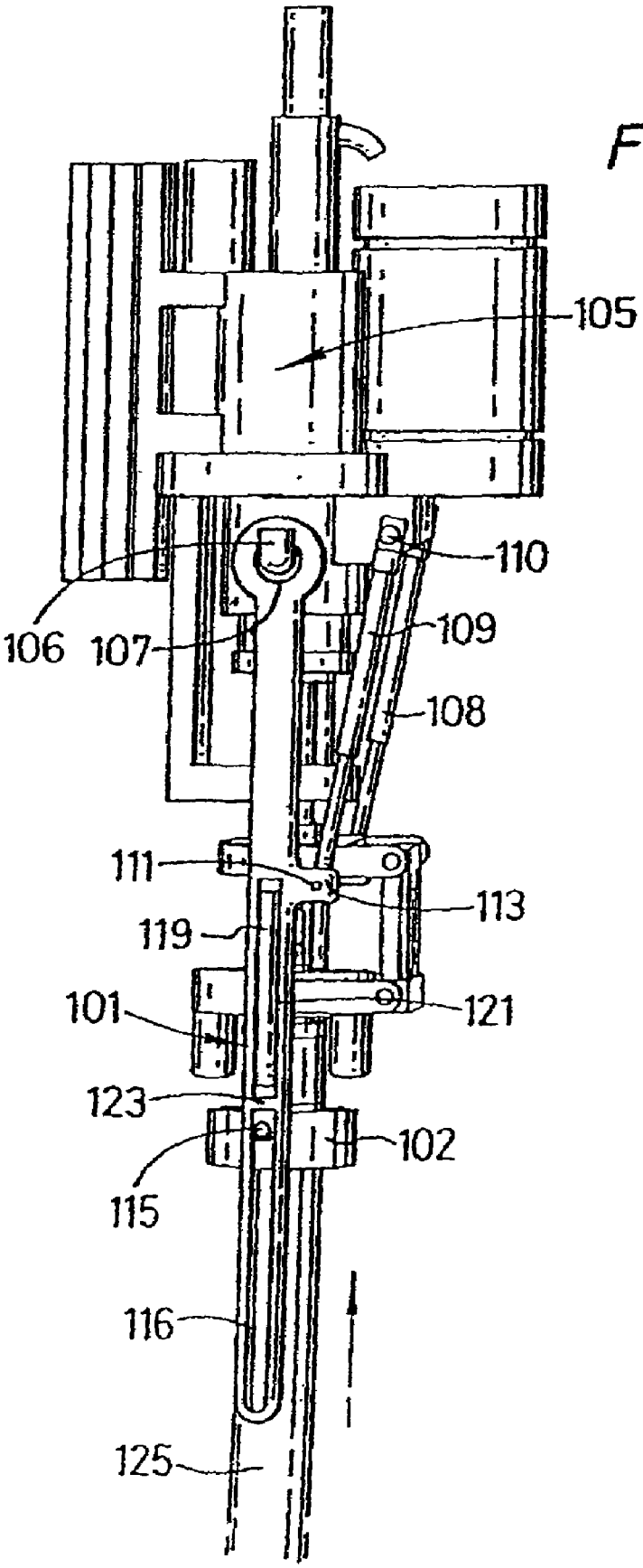

In use, a tubular 125 is angled from a rack near to the well centre. The tubular may however remain upright in the rack. The clamp 102 is placed around the tubular below a box 126 (FIG. 2*a*). The top drive is raised on a track on a derrick. The tubular is lifted from the rack and the tubular swings to hang vertically (FIG. 2*b*). The piston and cylinders 108, 109 are actuated, extending the pistons allowing the bails 103, 104 to move to a vertical position. The tubular 125 is now directly beneath a tool 127 for internally gripping and rotating the tubular 125 (FIG. 2*c*). The pistons 117, 118 and cylinders 119, 120 are now actuated. The pins 115 follow slot 116 and the clamp 102 moves upwardly, lifting the tubular 125 over the tool 127 (FIG. 2*d*). The tool 127 can now be actuated to grip the tubular 125.

At this stage the elevator 102 is released and the top drive 105 lowered to enable the tubular 125 to be connected to the string of tubulars in the slips and torqued appropriately by the top drive 105.

The pistons 117, 118 and cylinders 119, 120 are meantime extended so that after the tubular 125 has been connected the top drive 105 can be raised until the elevator 102 is immediately below the box. The elevator 102 is then actuated to grip the tubular 125 firmly. The top drive 105 is then raised to lift the tubular string sufficiently to enable the wedges in the slips to be withdrawn. The top drive 105 is then lower to the drilling platform, the slips applied, the elevator 102 raised for the tubular 125 and the process repeated.

While the foregoing is directed to embodiments of the present invention, other and further embodiments of the invention may be devised without departing from the basic scope thereof, and the scope thereof is determined by the claims that follow.

What is claimed is:

1. An apparatus for connecting casing sections by using a top drive, comprising:

at least one elevator;

at least two bails operatively coupled to the top drive at one end and the at least one elevator at another end;

an actuator operatively coupled to the at least two bails and configured to rotate the at least two bails about a horizontal axis, whereby the at least one elevator is moved from a first location substantially below the top drive to a second location out from under the top drive; and at least one gripping element operatively coupled to the top drive and configured to be radially displaceable for engagement with an outer wall of a casing.

2. The apparatus of claim 1, wherein the at least one elevator is adapted to maintain the casing in a substantially vertical position as the casing is moved into alignment with the vertical axis.

3. The apparatus of claim 2, wherein the at least one gripping element is rotatable by the top drive.

4. The apparatus of claim 1, wherein the at least one elevator is pivotally coupled to the two bails.

5. The apparatus of claim 1, wherein the at least two bails share a common axis of rotation.

6. The apparatus of claim 1, further comprising an axial actuator adapted to move the at least one elevator closer to the pivot point.

7. An apparatus for connecting casing sections by using a top drive, comprising:

at least one elevator;

at least two bails operatively coupled to the top drive at one end and the at least one elevator at another end;

an actuator operatively coupled to each of the at least two bails and configured to rotate the at least one bail about a horizontal axis, whereby the at least one elevator is moved from a first location substantially below the top drive to a second location out from under the top drive; and at least one gripping element operatively coupled to the top drive and configured to be radially displaceable for engagement with an inner wall of a casing.

8. The apparatus of claim 7, wherein the at least one elevator is pivotally coupled to the at least two bails.

9. The apparatus of claim 7, wherein the at least one elevator is adapted to maintain the casing in a substantially vertical position as the casing is moved into alignment with the vertical axis.

10. The apparatus of claim 9, wherein the at least one gripping element is rotatable by the top drive.

11. The apparatus of claim 9, further comprising a weight compensator.

12. The apparatus of claim 9, wherein the actuator comprises at least one piston and cylinder assembly.

13. An apparatus for connecting casing sections by using a top drive, comprising:

an elevator;

at least one gripping element operatively coupled to the top drive and configured to be radially displaceable for engagement with a casing;

at least one extendable member operatively coupled to the top drive at one end and the elevator at another end, wherein the at least one extendable member is retractable to move the elevator closer to the at least one gripping element; and an actuator operatively coupled to the at least one extendable member and configured to rotate the extendable member about a horizontal axis, whereby the at least one elevator is moved from a first location substantially below the top drive to a second location out from under the top drive.

14. The apparatus of claim 13, wherein the elevator is pivotally coupled to the extendable member.

15. The apparatus of claim 13, wherein the elevator is adapted to maintain the casing in a substantially vertical position as the casing is moved into alignment with the vertical axis.

16. The apparatus of claim 15, wherein the at least one gripping element is rotatable by the top drive.

17. The apparatus of claim 13, wherein two extendable members are used.

18. The apparatus of claim 17, wherein the two extendable members share a common axis of rotation.

19. The apparatus of claim 13, wherein the extendable member comprises a piston and cylinder assembly.

20. A method for handling a pipe in a rig, the rig including a spider, a top drive with a pipe engaging apparatus secured therebelow, and a link arm capable of pivoting relative to the pipe engaging apparatus, comprising:

coupling the link arm to a track on the rig;

using the link arm to pick up the pipe;

hoisting the top drive in the rig such that the pipe is rotated to a substantially vertical position while remaining engaged by the link arm;

positioning a lower end of the pipe onto a joint positioned in the spider such that the pipe is supported thereby;

slidably holding an upper portion of the pipe with the link arm;

engaging the upper portion of the pipe using the pipe engaging apparatus;

driving the pipe to connect it to the joint;

lowering the pipe until it is supported in the spider; and disengaging the pipe engaging apparatus from the pipe.

21. The method of claim 20, wherein the pipe engaging apparatus comprises radially movable gripping elements.

22. A method for handling a pipe in a rig, the rig including a spider, a top drive with a pipe engaging apparatus secured therebelow to define a main axis of the rig, the method comprising:

providing a link arm mounted by a pivotal connection to move with the top drive, the link arm driven to pivot about its pivotal connection through a plane of rotation at least between a lowered position and a raised position;

using the link arm to pick up the pipe;

hoisting the top drive in the rig such that the pipe is rotated to a substantially vertical position while remaining engaged by the link arm;

positioning a lower end of the pipe section onto a joint positioned in the rotary table such that the pipe is supported thereby;

slidably holding an upper portion of the pipe with the link arm;

engaging the upper portion of the pipe using the pipe engaging apparatus;

driving the pipe to connect it to the joint, wherein the link arm does not rotate relative to the pipe while the pipe is being driven;

lowering the pipe until it is supported in the spider; and disengaging the pipe engaging apparatus from the pipe.

23. The method of claim 22, wherein the link arm is coupled to a track on the rig.

24. The method of claim 22, wherein the pipe engaging apparatus comprises radially movable gripping elements.

* * * * *

UNITED STATES PATENT AND TRADEMARK OFFICE

CERTIFICATE OF CORRECTION

PATENT NO. : 7,353,880 B2
APPLICATION NO. : 11/560211
DATED : April 8, 2008
INVENTOR(S) : Pietras It is certified that error appears in the above-identified patent and that said Letters Patent is hereby corrected as shown below:

In the References Cited (56):

Please delete "2,692,059 A 10/1954 Boiling, Jr." and insert --2,692,059 A 10/1954 Bolling, Jr.-- therefor;

Please delete "3,747,875 A 7/1973 Brown" and insert --3,747,675 A 7/1973 Brown-- therefor;

Please delete "6,832,656 B2 12/2004 Keast" and insert --6,832,656 B2 12/2004 Fournier, Jr. et al.-- therefor;

Please delete "6,832,658 B2 12/2004 Fournier, Jr. et al." and insert --6,832,658 B2 12/2004 Keast-- therefor;

Please delete "WO-41485 8/1999" and insert --WO 99-41485 8/1999-- therefor.

Signed and Sealed this

Thirtieth Day of June, 2009

John Doll

JOHN DOLL
*Acting Director of the United States Patent and Trademark Office*